United States Patent [19]

Carter

[11] 4,304,291

[45] Dec. 8, 1981

[54] HEAT EXCHANGER FOR A CONVECTOR HEATER

[75] Inventor: Brian Carter, Paris, France

[73] Assignee: Tugonia AG, Zug, Switzerland

[21] Appl. No.: 49,972

[22] Filed: Jun. 19, 1979

Related U.S. Application Data

[63] Continuation of Ser. No. 762,186, Jan. 24, 1977, abandoned.

[30] Foreign Application Priority Data

Jan. 23, 1976 [GB] United Kingdom ..... 2764/76

[51] Int. Cl.[3] ..... F28F 1/20; H05B 3/50

[52] U.S. Cl. ..... 165/1; 165/129; 165/183; 219/365; 219/530; 219/540

[58] Field of Search ..... 165/129, 128, 183, 1; 219/365, 530, 540, 542, 544

[56] References Cited

U.S. PATENT DOCUMENTS

| | | | |
|---|---|---|---|
| 3,449,552 | 6/1969 | Graves | 165/183 |

FOREIGN PATENT DOCUMENTS

| | | | |
|---|---|---|---|
| 2275743 | 1/1976 | France | 165/183 |
| 570748 | 12/1975 | Switzerland | 165/183 |
| 2579248 | 10/1948 | United Kingdom | 165/183 |
| 1480833 | 7/1977 | United Kingdom | 165/183 |

*Primary Examiner*—Sheldon J. Richter

*Attorney, Agent, or Firm*—Wenderoth, Lind & Ponack

[57] ABSTRACT

A heat exchanger for a convector heater includes a tubular heat source and fins for assisting the transfer of heat from the heat source. The fins are arranged in two banks, and the banks are disposed in Vee formation. Preferably the fins are provided with stabilizing strips at their free ends and the heat source is a sheathed electric heating element.

13 Claims, 6 Drawing Figures

HEAT EXCHANGER FOR A CONVECTOR HEATER

This is a continuation of application Ser. No. 762,186, filed Jan. 24, 1977, now abandoned.

BACKGROUND AND SUMMARY OF THE INVENTION

The invention relates to a heat exchanger for a convector heater and a method of heating air thereby. Convector heaters rely on conduction of heat from a heat source to a flowing air-stream. Heat sources, particularly tubular electric heating elements, are usually such that basically only local heating of the air is possible directly from the source. Metal fins may be attached to the heat source to spread the heating effect but known arrangements do not achieve a satisfactorily uniform spread of air temperature across the stream. This may be because there is a local impedance to air or for some reason the heat exchange across the stream may be uneven.

The present invention seeks to provide an improved heat exchanger.

According to the invention there is provided a heat exchanger for a convector heater comprising an elongate heat source; a spine extending around and in intimate contact with the source for transfer of heat therefrom; and a pair of banks of fins projecting from the spine, the banks being disposed in Vee formation and the individual fins within each bank all being mutually parallel.

In operation the source of heat produces heat which is conducted via the spine along the fins. The heat is then transferred to air surrounding the fins, which air rises, thereby setting up a convection flow. A low resistance to this convection flow is obtained by aligning the fins with the convection flow which is normally vertical, or at least has a substantial vertical component. For this reason the fins in both banks preferably all have their planes mutually parallel.

Normally, the heat exchanger will be used in a convector heater which comprises a cabinet enclosing the heat source at the bottom, the banks of fins projecting upwardly and laterally within the cabinet. The fins will extend in vertical parallel planes transverse to the axis of the heat source, which will normally be horizontal. The fins face each other and therefore radiate heat towards each other. Thus, radiated heat is confined largely to the fins and the heat output from the heater is imparted to the circulating air, thus minimising directly radiated heat.

Preferably the source of heat is a sheathed electric heating element, preferably of the kind having a heater wire enclosed in metal oxide powder sheathed in a metal jacket. However, it is envisaged that the heat source may, for example, be a hot-water pipe.

BRIEF DESCRIPTION OF THE DRAWINGS

In order that the invention may be more readily understood, a specific embodiment thereof will now be described with reference to the accompanying drawings in which.

DETAILED DESCRIPTION OF THE INVENTION

Figure 1:
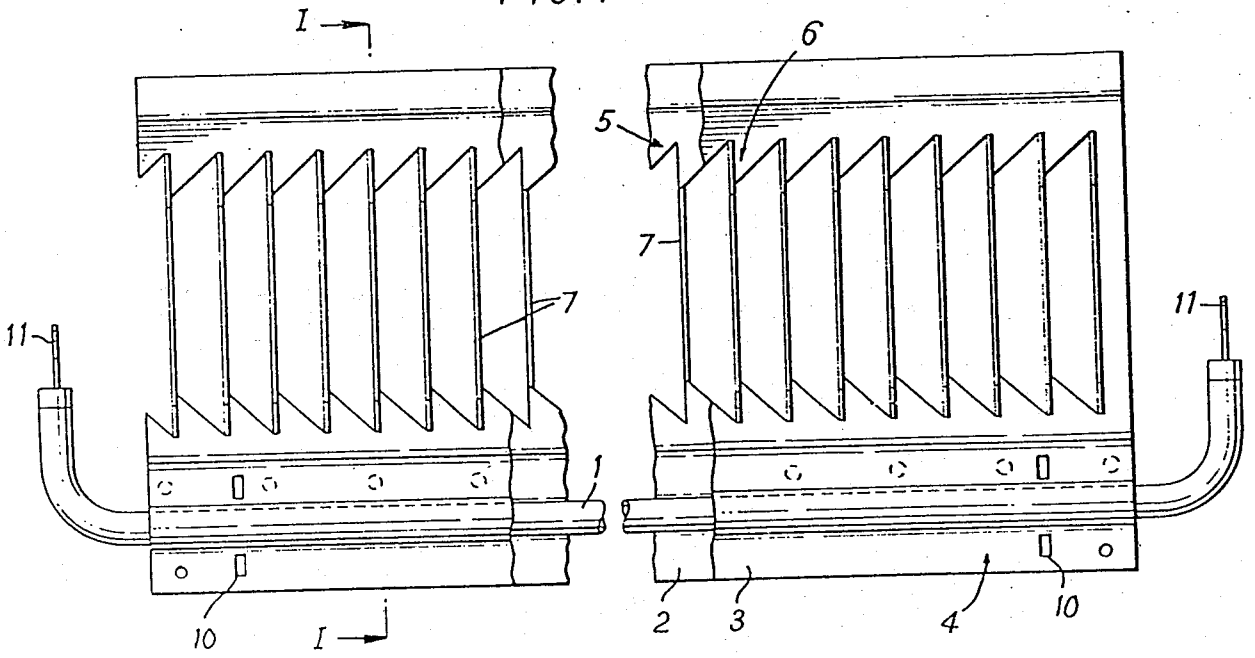
FIG. 1 is a broken side view of a heat exchanger according to the invention.

The heat exchanger of FIG. 1 has a sheathed electric heating element 1 as a source of heat. Two strips of aluminium 2,3 together constitute a spine 4 which extends around the element 1. Two banks 5,6 of fins 7 project upwardly and laterally from the spine 4. The individual fins have been stamped out and bent from two sheets of aluminium, one sheet for each bank, of which the strips 2,3 are integral parts. At their top ends, the fins are secured together by integral strips 8,9 of the sheets. These strips stabilise the fins which otherwise might easily be damaged in handling of the heat exchanger. The heat exchanger can be fixed in position by means of tabs through rectangular holes 10 in the spine 4. The sheathed element 1 can be connected to an electricity power supply by connectors 11.

When the element of FIG. 1 is in operation it is intended that it should be positioned generally horizontally as shown in FIG. 1 within a cabinet, not shown. The fins are all in vertical planes. Air driven by convection will flow up through the heat exchanger with little resistance. As it passes between the fins it will be heated. The air is heated almost wholly by conduction by contact with the fins. The bulk of the radiation from the heat exchanger will be from planar surfaces 12 of the fins. Since the fins face each other radiated heat will be directed from fin to fin and very little heat is therefore lost to the surroundings by radiation.

Figure 2:
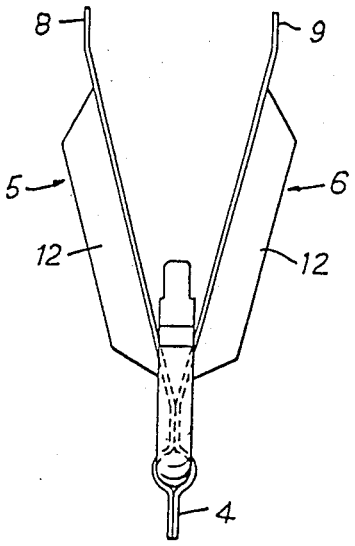
FIG. 2 is an end view of the heat exchanger of FIG. 1.

As can be seen the angle of the Vee between the banks 5,6 of the fins is 30°. Also, FIG. 2 shows that the strips 8 and 9 and the spine 4 are disposed to give the minimum resistance to the convection flow, since they are substantially vertical in use.

Figure 3:
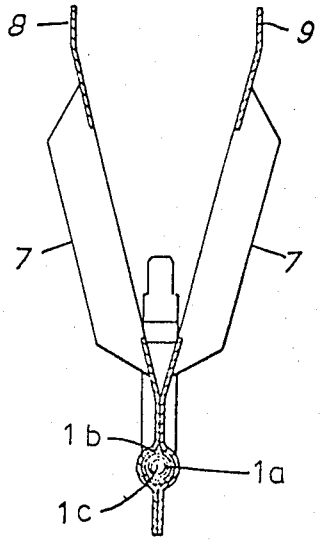
FIG. 3 is a section on the line I—I in FIG. 1.

FIG. 3 shows the shape of the spine 4 in the region of the element 1. The strips 2,3 are spot-welded together to form the spine which is thus maintained in intimate contact with the element, thereby ensuring good heat transfer from the element to the spine. The element is shown as comprising an internal heater wire 1*a*, an external metal sheath 1*b*, and an insulating filling of magnesium oxide 1*c*. FIG. 3 also shows that the fins extend outwardly of each bank with respect to the centre of the Vee.

Figure 4:
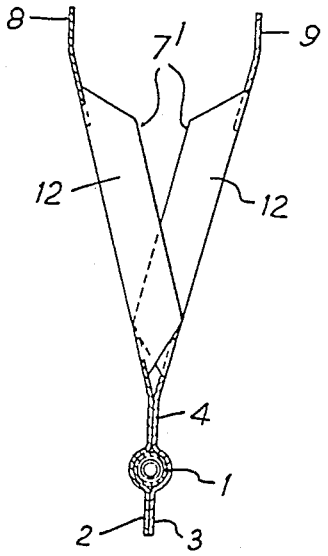
FIG. 4 is a similar section showing a modification of the heat exchanger of FIG. 1.

FIG. 4 shows a modification wherein fins 7' extend inwardly, and interleave. These fins function in a similar manner to the fins 7.

Figure 5:
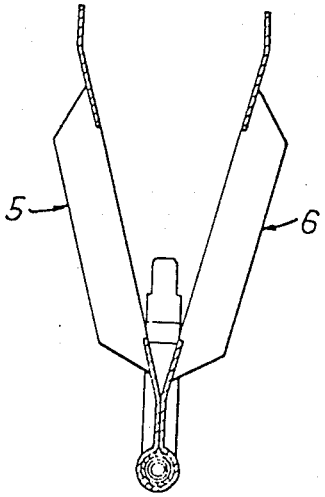
FIG. 5 is another similar section showing another modification.

FIG. 5 shows another modification wherein the two banks are formed from a single piece of sheet aluminium. Thus the spine does not extend below the heating element, except in so far as it passes around the bottom of the element in intimate contact therewith. This modification makes more economical use of the aluminium used, but requires a larger stamping to be made.

The angle of the Vee between the banks can be varied according to the size of the cabinet, so that there is only a small gap between the strips 8,9 and the sides of the cabinet. With a large cabinet more than one heat exchanger can be installed side-by-side, or one above the other.

Figure 6:
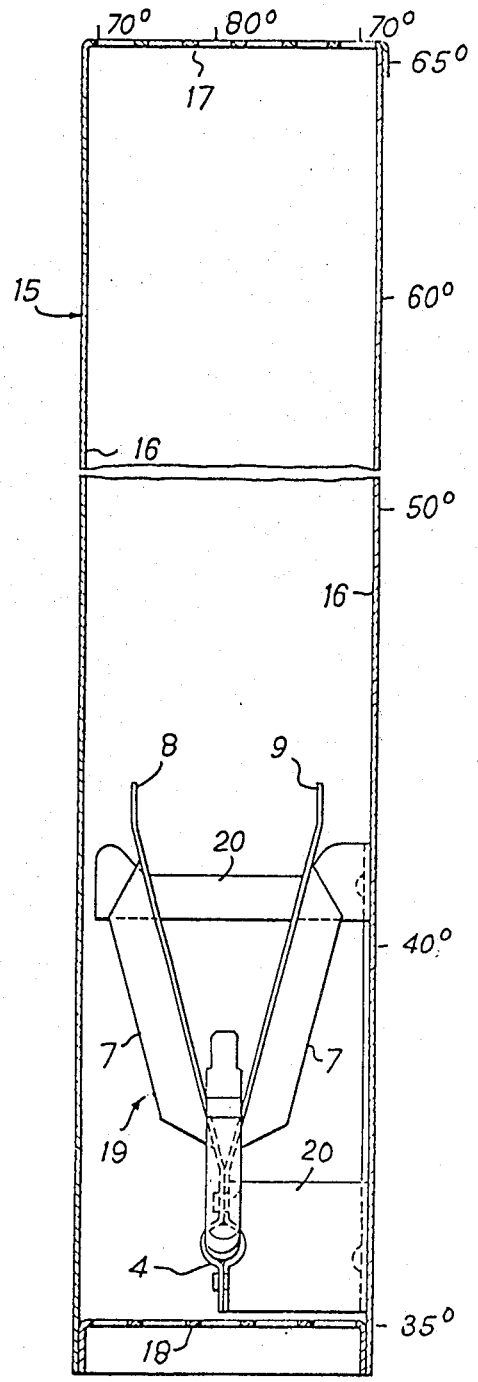
FIG. 6 is a cross-sectional view of a convector heater embodying the invention.

FIG. 6 shows a heat exchanger of the kind shown in FIGS. 1 and 3 incorporated in a convector heater. The convector heater comprises a cabinet 15 shown in cross-section in FIG. 6. The cabinet is box-shaped and has two end walls and two side walls 16. The cabinet has upper and lower grilles 17 and 18. The cabinet is intended for wallmounting by way of brackets (not shown).

A heat exchanger of the kind shown in FIGS. 1 to 3 is shown at 19 and is supported in the cabinet by brackets 20 at the spine 4 and the stabilizing strips 8,9. The electric element has a capacity of 1 kw, the banks of the fins are 550 mm long and 75 mm wide. The spine is 35 mm deep and the element is spaced 17 mm from the bottom of the spine. There are 49 fins in each bank, each fin being approximately 10 mm by 65 mm.

The dimensions of the cabinet are 600 mm by 300 mm×65 mm. In this heater, typical operating temperatures across the top grille and on the sides of the cabinet are as shown in °C. in the drawing.

The heat exchanger described above, has the advantage of producing a convection flow of air having a good temperature distribution, that is one which is not considerably hotter in the centre of the air stream compared with the edges of the stream. This in turn has the advantage that, for a given eveness of temperature distribution at the top of the cabinet, the cabinet need not be as tall as is conventional.

The invention is not restricted to the details of the foregoing description made with reference to the drawings. For example, the heat exchanger may be made by an extrusion process, an extruded body of 'T' section being formed with a totally enclosed channel in the leg of the 'T'. The arms of the 'T' are stamped to form the fins and bent upwardly to form the "Vee". With this arrangement the leg of the 'T' forms the spine and the tubular heater is constituted by the channel. It is possible to pass hot water or steam along the channel. Alternatively an electric heater may be consituted by passing a heating wire down the channel and packing the channel with magnesium oxide powder as electrical insulation. The ends of the channel would then be provided with ceramic plugs fitted with electrical connectors for connection to the heated wire.

I claim:

1. A method of heating air comprising the steps of:

supplying heat to a horizontal elongate heat source of a heat exchanger;

transferring said heat from said elongate heat source to a spine of said heat exchanger extending in intimate contact with said elongate heat source;

transferring said heat from said spine to a plurality of parallel vertical fins of said heat exchanger for heating said fins, said fins projecting in a single Vee formation of only two banks of parallel fins from said spine, each said fin being planar and being connected at opposite end portions thereof to a flat metal sheet along a straight line extending approximately transverse to the longitudinal axis of said spine, each said fin around its periphery other than said end portions being severed from said sheet, each said fin being sharply bent along said straight line away from the plane of said sheet to extend substantially perpendicular thereto and to said heat source, each said fin having a planar surface directly facing the planar surface of the said fin which is parallel and adjacent thereto, whereby heat which is radiated from each such heated fin reaches said adjacent fin and is retained in said heat exchanger for transfer to air to be heated;

supplying a convection flow of air to be heated vertically to said heat exchanger so that said air flows past said heated fins; and heating said air flowing past said heated fins by transfer of heat from said heated fins.

2. A method of heating air as claimed in claim 1, further comprising disposing said heat exhanger so that said Vee is upright.

3. A method of heating air as claimed in claim 1, further comprising supplying said heat to said elongate heat source by an electric heating element.

4. A heat exchanger for a convector heater, said heat exchanger comprising:

an elongate heat source;

a spine extending around and in intimate contact with said elongate heat source for transferring heat therefrom;

two only flat metal sheets extending from said spine and extending in only two planes parallel to the longitudinal axis of said spine;

each said sheet having formed therein cuts defining a plurality of fin portions extending in longitudinal directions approximately transverse to said axis of said spine, each said fin portion having opposite end portions integral with and connected to said sheet along a straight line extending approximately transverse to said axis of said spine, each said fin portion around its periphery other than said end portions being severed from said sheet by said cuts, each said fin portion being sharply bent along said line to thereby form a planar fin which extends entirely from one side only of the plane of said sheet in a direction substantially perpendicular to said plane of said sheet, all of said fins of each said sheet extending from the same side of said sheet in parallel relationship;

said two sheets being aligned such that said plurality of fins extending from said two sheets together form a single Vee formation of only two banks of parallel fins for transferring heat to a convection air flow, each said fin having a planar surface directly facing the planar surface of the said fin which is parallel and adjacent thereto, and each said fin radiating heat directly to said adjacent fin, thereby retaining heat in said heat exchanger for transfer therefrom by convection; and each said sheet having a stabilizing strip formed by a portion of said sheet extending between and connecting ends of said fins of the respective said bank of fins remote from said spine.

5. A heat exchanger as claimed in claim 4, wherein each said bank of fins is stamped from a separate said sheet, and said banks are spot-welded together at said spine.

6. A heat exchanger as claimed in claim 4, further comprising:

a rectangular cabinet;

an upper grill on said cabinet;

a lower grill on said cabinet;

said heat source and said fins being supported at the bottom of said cabinet with said heat source at a level below said fins; and said fins being aligned for vertical convectional air flow.

7. A heat exchanger as claimed in claim 4, wherein said fins extend outwardly of each respective said bank with respect to the center of the Vee.

8. A heat exchanger as claimed in claim 4, wherein said fins extend inwardly of each respective said bank with respect to the center of the Vee.

9. A heat exchanger as claimed in claim 4, wherein each said planar fin is in the shape of a trapezoid having a short side which is free and remote from the respective said sheet, a long side including said line whereat said fin is sharply bent, and angled sides which are free, said short side being connected to a said long side of the adjacent said fin along said line between said end portions of said adjacent fin prior to bending of said fin along said line.

10. A heat exchanger as claimed in claim 4, wherein said two sheets are integrally joined as a single sheet member which is bent around said elongate heat source and spot-welded at said spine.

11. A heat exchanger as claimed in claim 4, wherein said fins and said spine are made of aluminum.

12. A heat exchanger as claimed in claim 4, wherein said elongate heat source comprises a sheathed electric heating element.

13. A heat exchanger for a convector heater, said heat exchanger comprising:

an elongate tubular sheathed electric heating element;

a spine surrounding and in intimate contact with said electric heating element for transferring heat therefrom, said spine comprising two elongate pieces of aluminum spot-welded together around said heating element;

a plurality of parallel fins projecting in a single Vee formation of only two banks of parallel fins, each said bank of fins projecting from one of said elongate pieces of aluminum for transferring heat to a convectional air flow, said fins all being mutually parallel and extending outwardly from each said bank with respect to the center of the Vee formation, said fins being planar and trapezoid shaped, each said fin being connected at opposite ends only of a long side of said trapezoid to the respective one of said elongate pieces of aluminum whereat it is sharply bent substantially perpendicular to said piece of aluminum along a line coincident with said long side and being severed from said piece of aluminum at angled sides of said trapezoid, and each fin except the end fin in each bank being severed at a short side of the said trapezoid thereof from the long side between the said ends of the fin adjacent in one direction and being severed at its long side between said ends from the short side of the said fin in the other direction; and two stabilizing strips extending between and connecting the said ends of said fins remote from said spine in each respective said bank of fins, said stabilizing strips being aligned with the convectional flow of air through said heat exchanger.

* * * * *